United States Patent [19]

LaLonde

[11] Patent Number: 4,485,605

[45] Date of Patent: Dec. 4, 1984

[54] SUSPENSION CEILING GRID WITH REMOVABLE GRID MEMBERS

[75] Inventor: Paul D. LaLonde, Lorain, Ohio

[73] Assignee: Donn Incorporated, Westlake, Ohio

[21] Appl. No.: 232,195

[22] Filed: Feb. 6, 1981

[51] Int. Cl.[3] ..... E04B 5/52

[52] U.S. Cl. ..... 52/665; 52/484

[58] Field of Search ..... 52/484, 486, 666, 665, 52/664, 488, 726, 739, 728; 403/216, 217; 52/762

[56] References Cited

U.S. PATENT DOCUMENTS

| | | | |
|---|---|---|---|
| 2,689,630 | 9/1954 | Drury | 403/217 |
| 3,054,482 | 9/1962 | Lassen | 52/726 |
| 3,590,544 | 7/1971 | Shepherd | 52/484 |
| 3,640,557 | 2/1972 | Nute | 52/726 |
| 3,696,571 | 10/1972 | Schluter | 52/726 |
| 3,835,614 | 9/1974 | Downing, Jr. | 52/666 |
| 3,898,784 | 8/1975 | Sauer et al. | 52/726 |
| 4,019,300 | 4/1977 | Sauer | 52/665 |
| 4,047,336 | 9/1977 | Stahlhut et al. | 52/28 |
| 4,047,348 | 9/1977 | McSweeny | 52/666 |

*Primary Examiner*—John E. Murtagh

*Attorney, Agent, or Firm*—Pearne, Gordon, Sessions, McCoy, Granger & Tilberry

[57] ABSTRACT

A suspension ceiling grid having removable grid members is disclosed. Such grid is of the basketweave type and includes a plurality of grid assemblies interconnected to form a grid. Each assembly is provided with a similar first or male connection at its ends and second or female connections at its center. In the grid, the assemblies are interconnected so that the male connections of adjacent grids meet with and connect with the female connections at the center of the assemblies to provide a basketweave type system. Each grid assembly includes two similar grid members each having a first connection at one end and one-half of a second connection at its other end. In the assembly, a removable clip provides a semipermanent connection between adjacent ends of the two members and the two halves of the second connections cooperate to provide one full second connection. Individual grid members may be removed from an existing grid and replaced without creating the situation in which the grid is unstable.

11 Claims, 7 Drawing Figures

SUSPENSION CEILING GRID WITH REMOVABLE GRID MEMBERS

BACKGROUND OF THE INVENTION

This invention relates generally to grid-supported suspension ceilings, and more particularly to a novel and improved grid structure for such systems.

PRIOR ART

Various grid systems for suspension ceilings are known. One general type combines main runs which are supported at intervals along their lengths with cross runs which are mounted at their ends on adjacent main runs to define a grid having openings in which ceiling panels are mounted.

Another type of grid system, often referred to as a "basket weave system," provides a plurality of similar runners each having similar first end connections at both of its ends and similar second connections midway along its length. The runners are structured so that the first end connections of the runners connect with the second connections of an associated runner, so that the runners form a grid in which the ends of the runners are joined at the center of the next runner and extend perpendicularly to such runner. In such systems, the grids form square openings the side dimensions of which are substantially equal to one-half of the length of the runner. Examples of such systems are illustrated in U.S. Pat. Nos. 3,835,614 (assigned to the assignee of this invention) and 4,047,348.

In the basket weave systems, the grids are sometimes also provided with additional runners, such as T-runners, used for boundary grid fill or for dividing the large square openings into smaller, rectangular openings. Further, in some instances, such grids are used to produce ceilings having truncated pyramids within the openings, as illustrated in U.S. Pat. No. 3,835,614, supra.

One of the advantages of the basket weave system is that the runners are relatively long and tend to require a smaller number of runner members for a given ceiling size. This tends to reduce installation costs, since fewer runners have to be installed and since more area is covered with the installation of a given runner.

It is also known to use connector clips to join endwise abutting runners where such clips bridge the abutting ends and separately connect with each runner of a pair of runners. Examples of such systems include U.S. Pat. Nos. 3,054,482; 3,590,544; 3,640,557; and 4,019,300.

It is sometimes desirable to remove and replace a given runner within an existing grid system. For example, if a particular runner is provided with a lighting fixture, air boot or other accessory item, and it is desired to move such accessory to a different location or to install an additional accessory at a given location, it is normally necessary to remove and/or replace a given runner element within the existing grid. In a typical basket weave grid system, such removal of a grid is quite difficult and normally requires substantial disassembly of the grid.

SUMMARY OF THE INVENTION

In accordance with the present invention, a novel and improved suspension ceiling grid assembly is provided which is particularly suited for use in a basket weave grid system. The grid assembly is arranged for relatively easy installation, and so that a particular grid member within the grid system can be removed and replaced without difficulty. For example, if a particular grid element is damaged, it can be easily removed and replaced by an undamaged grid member without any significant grid disassembly.

Further, in instances in which the grid member is combined with an accessory such as a lighting fixture, air boot, or any other type of accessory, and it is desired to move the member and the accessory to another location, to remove an accessory, or to install an additional accessory, this invention permits easy removal and replacement of the grid member and such accessory without undue disassembly of the installed grid.

In accordance with the illustrated embodiment of this invention, a grid member cross section is provided which is similar to the one illustrated in U.S. Pat. No. 3,835,614. Two similar grid members are connected together by a clip connection to provide a two-member runner assembly. Such assembly provides similar first connections at its two ends and similar second connections at the center of the assembly. The first connections are structured to mate with an associated second connection when the assemblies are installed in a basket weave-type grid.

Because the assemblies consist of two end-connected grid members and are installed as a unit, a runner length equal to the length of two grid members is installed each time a given assembly is installed.

The first and second connections and the clip connection of the assemblies, however, are structured so that a given member can be removed and replaced without further disassembly of the grid system. Further, such connections are structured so that the remaining grid system remains stable when one member is removed and until such member is reinstalled or replaced.

Further, with the present invention, the two members of an assembly can be disconnected and be individually used when fill pieces are required, either within or around the grid.

These and other aspects of this invention are more fully described in the following description and in the drawings.

DETAILED DESCRIPTION OF THE DRAWINGS

Figure 1:
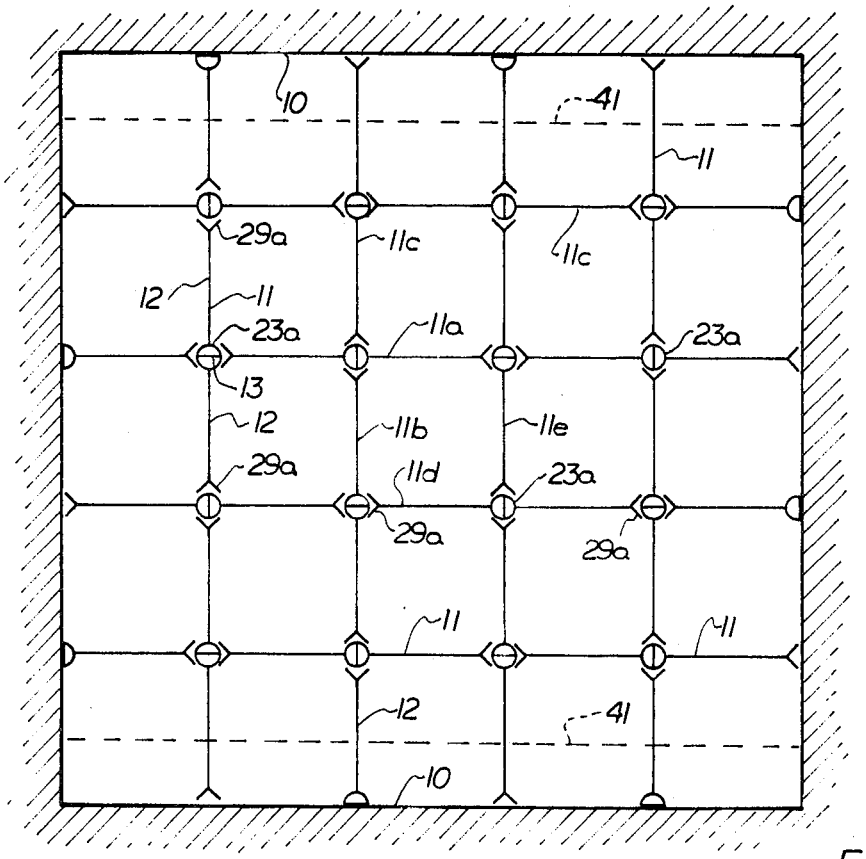
FIG. 1 is a diagrammatic view of a basket weave grid system incorporating the present invention.

In FIG. 1, a basket weave grid system in accordance with the present invention is diagrammatically illustrated. In such figure, 10 schematically represents the walls of a room in which a grid is mounted. The grid consists of a plurality of runner assemblies 11 each consisting of two runner members 12 connected at their adjacent ends at 13 by a connector clip.

Figure 2:
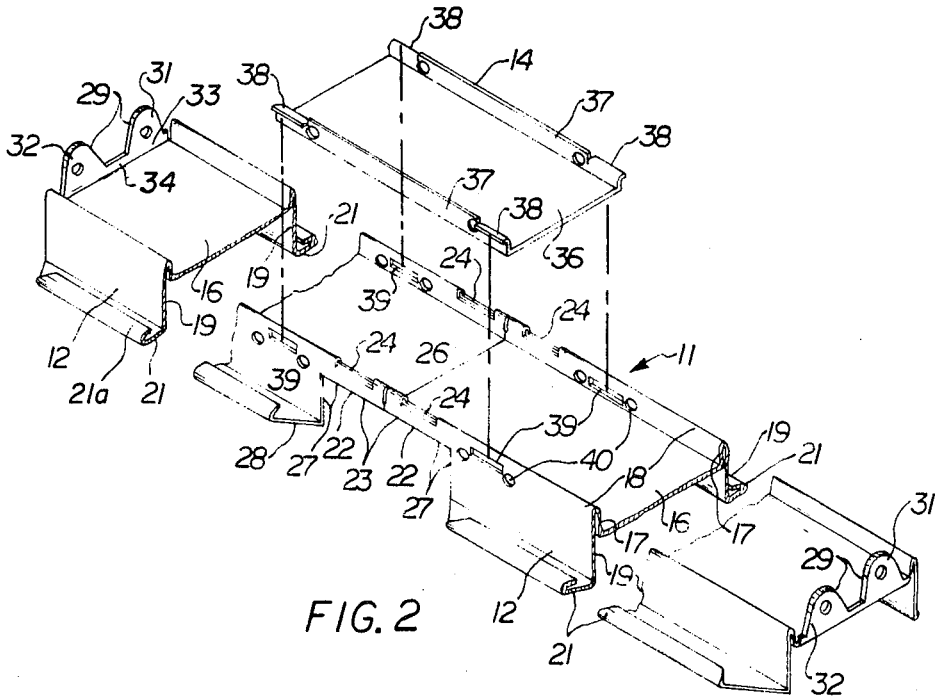
FIG. 2 is a broken perspective view of a grid runner assembly prior to the installation of the connecting clip.

FIG. 2 is a broken perspective view of a single runner assembly prior to the installation of a mounting clip 14, which provides the connection between the two runner members 12 of the assembly. The two runner members 12 are identical in structure. In the illustrated embodiment, each runner member is formed of sheet metal shaped to provide a central web 16 joined along opposite edges to a vertically extending wall portion 17. At the upper edge of the wall portion 17 a reverse bend is formed at 18. A second vertically extending wall portion 19 extends downwardly from the associated reverse bend 18 substantially parallel to and slightly spaced from the adjacent first wall portion 17 to an associated lateral flange 21. The two wall portions 17 and 19 cooperate to provide an upstanding wall. The second wall portions 19 are longer than the first wall portions 17, and as a result, the flanges 21 are spaced below the central web 16. The outer edges of the flanges are formed with a hem at 21*a*. This cross section is essentially the same as the cross section illustrated in U.S. Pat. No. 3,835,614, assigned to the assignee of the present invention.

The two runner members are each provided with one-half of a female connection 22 and in the assembly the connections 22 abut and cooperate to provide a full female connection 23. The connection 23 is a dual or a two-part connection, consisting of a slot 24 in the reverse bend 18 adjacent to the abutting ends 26 of the two runner members. These slots 24 provide spaced openings which communicate with the zone between the two wall portions 17 and 19 beneath the reverse bends 18. Each of the runner members 12 is also formed with a notch 27 in the second sidewall portion extending back from the abutting ends 26 a distance substantially equal to one-half the spacing between the opposite second wall portions 19 so that when the runner members 12 are in abutting relationship illustrated, a side opening is provided by the two adjacent notches 27 in each second wall having a width which mates with the ends of the sidewall portions 19 of an adjacent connected member. The ends of the flanges 21 are also mitered at 28 so as to provide a mitered joint at the junction of the various runner assemblies in an assembled gird.

The two slots 24 cooperate in an assembly to provide a dual female connection proportioned to connect with the male end connections 29 provided at the opposite ends of the two runner members 12. The male connections are formed by blanking out a pair of projections 31 and 32 at the ends of the central web 16 remote from the abutting ends 26 and bending the ends of the web 16 at a bend line 33 to an upward position in which the two projections 31 and 32 project upwardly from the plane of the web 16. Between the projections 31 and 32 and the bend line 33 is a short full wall portion 34.

The adjacent abutting ends 26 of the two runner members of an assembly 11 are connected by the mounting clip 14. The mounting clip is generally U-shaped or channel-shaped and includes a central wall 36 having an upstanding flange 37 at each side thereof. Ajdacent to each end of each flange 37 is an outwardly extending tab 38 which is proportioned to snap into an associated lateral slot 39 formed in the two wall portions 17 and 19. The various elements are proportioned so that the wall 36 fits tightly against the adjacent web 16 when the clip is installed, as illustrated in FIGS. 3 and 4, while the flanges 37 engage the adjacent wall portions 17 and the tabs 38 extend through the slots 39.

When installed, the clip provides a semipermanent connection between the two runner members 12 of the assembly 11. However, the clip can be removed by merely springing the clip inwardly until the respective tabs 38 clear the associated slots 39, allowing the clip to be removed. Installation of the clip is accomplished by moving the clip into position while the parts are deflected so that the tabs 38 can move down to a position adjacent to the associated slots 39 and when the clip is properly aligned the parts are allowed to return to their unstressed condition in which the tabs 38 project into the associated slots to provide the semipermanent connection between the adjacent ends of the two runner members.

In normal practice, the assemblies 11 are produced by connecting two runner members with a clip 14 at the time the runners are manufactured. However, it is also within the scope of this invention to provide such connection immediately before the runners are installed in a given grid.

Figure 3:
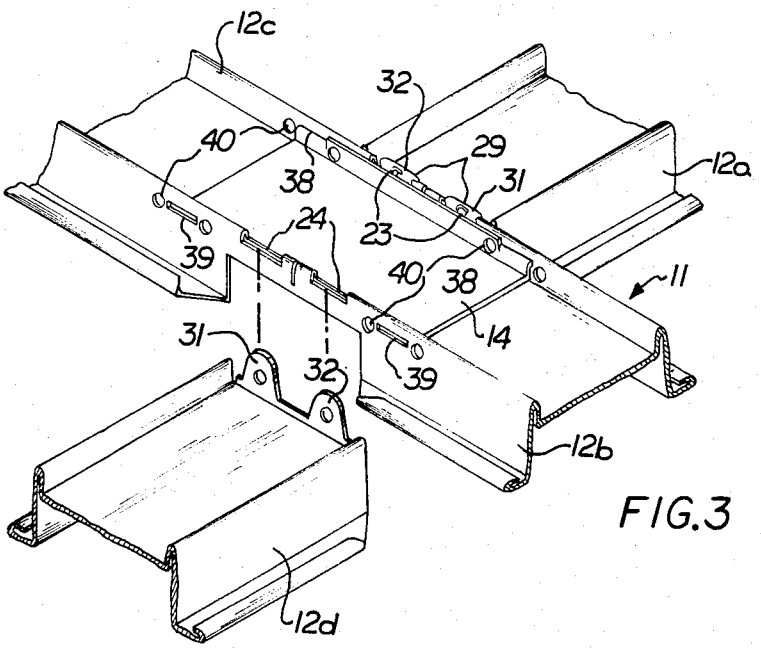
FIG. 3 is a fragmentary, perspective view of a grid intersection illustrating one grid member positioned for connection with the adjacent associated grid runner assembly.
Figure 4:
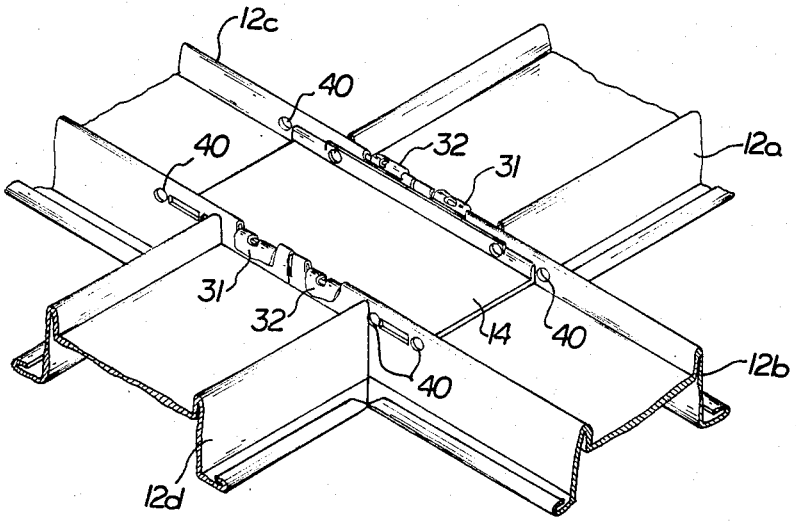
FIG. 4 is a fragmentary, perspective view illustrating a complete grid intersection.

FIGS. 3 and 4 illustrate the manner in which intersecting connections are formed between the male connections 29 at the ends of an assembly and the female connections 23 at the middle of each assembly.

FIG. 3 illustrates the male end connection 29 of a runner member 12*a* connected to the adjacent and associated female connection 23 of an assembly 11 consisting of runner members 12*b* and 12*c*, which are connected by a connector clip 14. In such position, the projections 31 and 32 project up through the associated slots 24 formed in the runner member 12*b* and 12*c*, respectively, and are bent outwardly and down, as illustrated in FIG. 3, to connect the end of the runner member 12*a* to both of the runner members 12*b* and 12*c*.

The end of a fourth runner member 12*d* is illustrated in FIG. 3 before the connection is made, but positioned so that the projections 31 and 32 thereof are directly below the associated slots 24. Completion of the connection of the runner member 12*d* is accomplished by raising the end thereof so that the projections 31 and 32 thereof extend up through the associated slots 24, bringing the various flanges into alignment. After this raising movement, the upper ends of the projections 31 and 32 are bent down to complete the connection, as illustrated in FIG. 4.

Referring now to FIG. 1, each of the assemblies 11 consists of two runner members 12 connected together at their center so as to provide a male connection 29 at the opposite extremities and a female connection 23 at the center. In FIG. 1, the male connections 29 are represented by a "V" 29*a* and each of the female connections 23 is represented by two semicircles which join to form a full circle 23*a*. This diagrammatically represents the female connection 23 consisting of the two halves of the female connection provided at the adjacent abutting ends of the runner members of the assembly. In FIG. 1, the male end connections are shown adjacent to the associated female connections merely for purposes of illustration, but it is intended that this showning represents a full connection.

In a basket, weave grid, an assembly 11*a* is connected at its center to an assembly 11*b* and an assembly 11*c*. Connected to the middle of the assembly 11*b* is an assembly 11*d*. From the middle of an assembly 11*d*, an assembly 11*e* extends to a connection with the adjacent end of the assembly 11*a* and to a connection with an assembly 11*f*. It should be noted that as each additional assembly is installed, the runner assembly having a length equal to two times the length of the runner members is installed, and a full panel opening is completed. When the ceiling size permits, peripheral fill is provided by single runner members 12 which extend between the adjacent wall 10 and the next intersection. For purpose of illustration, the walls 10 in FIG. 1 are dimensioned so that full runner members are used throughout the grid. However, in many instances, the room dimensions will not exactly match the full span size of the runner members, and the walls may exist at an intermediate location indicated by the dotted lines 41. In such instance, the various runner members are cut off at the proper length to join with the wall and, in some instances, special slip-on fittings are provided to be positioned on the end of the cut-off runner member to provide a neat junction with the walls.

In instances in which the assemblies are connected by the connection plates 14 at the time of manufacture, it is a simple matter to remove the connection plate 14 to provide individual runner members 12 to be used as fill in a given grid.

Basket weave runners having male end connections as illustrated and female center connections as illustrated have been known and are known to the prior art. However, such runners are integrally formed as a single element and are not constructed of two similar runner members joined by a connector plate. In such prior art, it is virtually impossible to replace a single runner from an existing grid (for example, to replace a damaged runer) or to remove a single runner to provide a substitute runner adapted to support an accessory, such as the lighting fixture illustrated in FIG. 7. In such prior art basket weave systems of the type generally disclosed herein, it is necessary, in most instances, to provide a substantial disassembly of a grid in order to replace a single runner and grid instability is often encountered in the partially disassembled grid.

Figure 5:
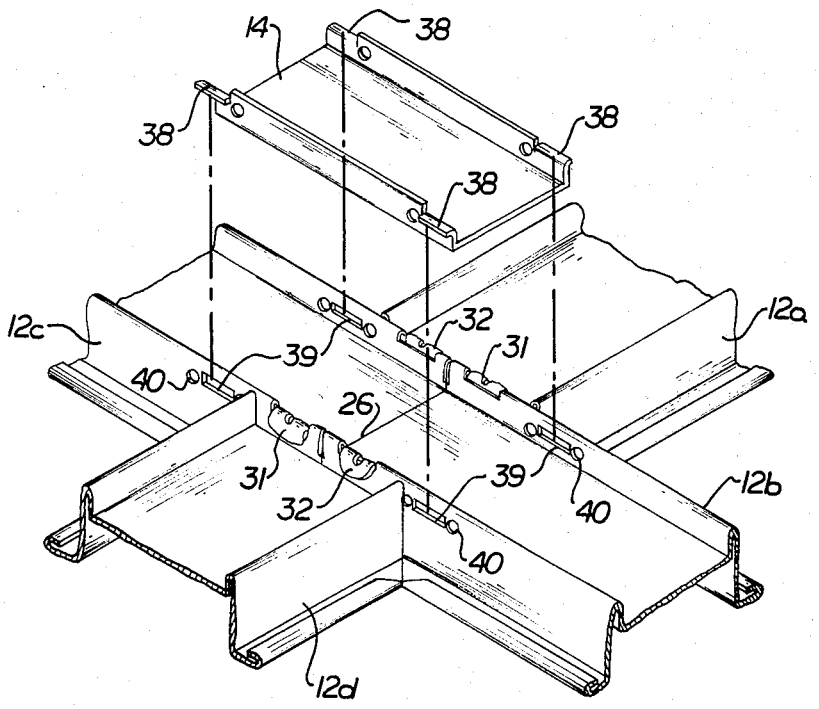
FIG. 5 is a fragmentary, perspective view, similar to FIG. 4, but illustrating the grid intersection after the removal of the connecting clip.

With the present invention, it is relatively simple to remove a given runner member from an existing grid system and the grid remains stable after such removal. Referring to FIGS. 3 through 5, a fully connected intersection is illustrated in FIG. 4. If it is necessary for some reason to remove the grid member 12*c* from an existing grid, such removal can be accomplished without disassembling any portion of the grid other than the grid member 12*c*. There are two procedures by which the runner 12*c* may be removed. With one procedure, the first step of removing the grid member 12*c* involves the removal of the connector clip 14, as illustrated in FIG. 5. This is accomplished by springing the elements until the projections 38 along at least one side of the clip move clear of the associated openings 39. The connector clip 14 is then raised up out of the intersection, as illustrated in FIG. 5. The intersection, however, remains stable, since the projections 31 and 32 of the grid members 12*a* and 12*d* bridge the abutting ends 26 and continue to provide a connection holding the abutting ends of the intersection together.

Figure 6:
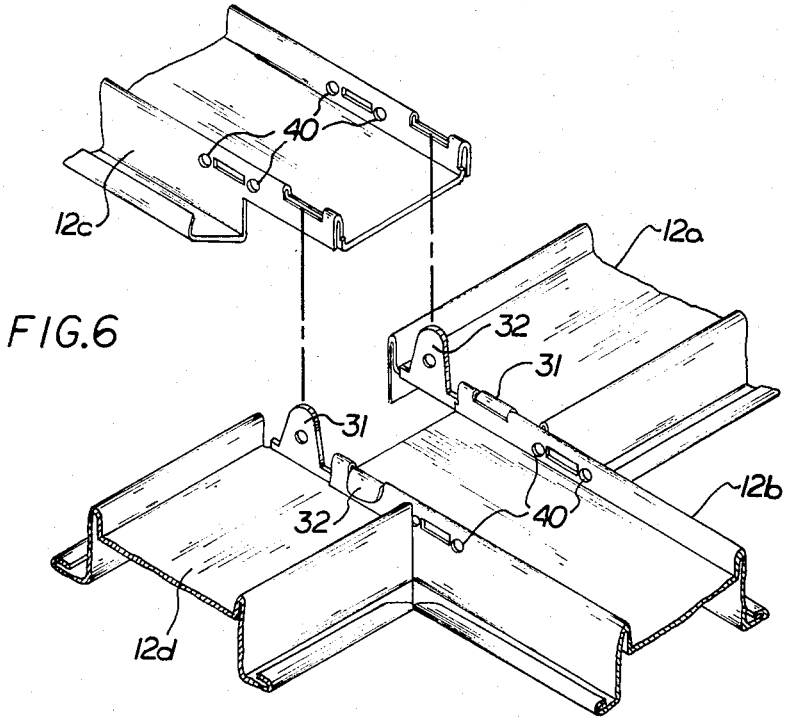
FIG. 6 is a fragmentary, perspective view illustrating the grid intersection after the removal of one of the grid members.

The final removal of the grid member 12*c* is accomplished by bending the projection 32 of the runner member 12*a* and the projection 31 of the runner member 12*d* to the vertical position as illustrated in FIG. 5. This unlocks the connection between the runner 12*c* and the two runners 12*a* and 12*d*, allowing the end of the runner 12*c* to be raised as illustrated in FIG. 6. The opposite end of the runner 12*c* is, of course, provide with a similar male connection and is released by bending the two projections 31 and 32 of the runner 12*c* to the vertical position, allowing downward removal of that end of the runner 12. Removal of the opposite end does not require the removal of the connector clip, since downward disconnecting can be accomplished without interference with such clip.

Another procedure for removing the runner 12*c* is as follows. First, the projection 31 of the runner 12*d* and the projection 32 of the runner 12*a* are bent up to the vertical position. Then the sides of the clip are deflected inward adjacent to the openings 39 of the runner 12*b* until the projections 38 clear such openings. The end of the runner 12*c* is then raised, while the clip remains connected to the runner 12*c*. The other end of the runner 12*c* is then released as described above. The advantage of this procedure is that it does not require a step involving the separate removal of the clip.

Two openings 40 are provided at the ends of the runner members, with one on each side of the slots 39. One opening 40 is beyond the end of the clip and the other is aligned with an associated opening in the clip. Hanger wires or hanger clips (not illustrated) are positioned in such openings to support the grid. If a hanger wire is connected through an opening 40 aligned with the clip 14 that is to be removed, such wire is moved to the opening 40 in the runner 12*b* beyond the clip so that the support remains and the clip can be removed.

After the runner 12*c* is removed from the grid, the grid is still stable because the runner 12*a* is connected to the runner 12*b* by the remaining projection 31 and the runner 12*d* remains connected to the runner 12*b* by the projection 32.

A substitute runner member is then reinstalled in the grid system by reversing the procedure. If desired, the connector clip can be reinstalled; however, it is not necessary to reinstall such connector clip since the installation of a substitute runner again provides a bridging connection between the end of the runner 12*b* and the substitute runner which replaces the runner member 12*c*.

Figure 7:
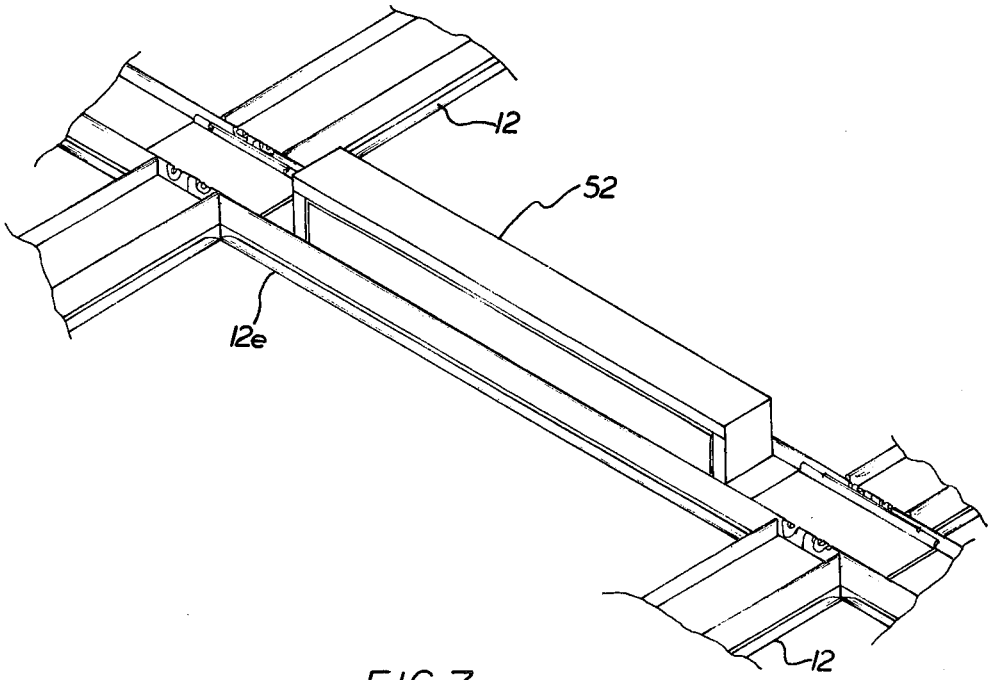
FIG. 7 is a perspective view of a grid member in accordance with the present invention with a fluorescent lighting accessory mounted thereon.

The removal of a given runner member can be required for a number of reasons. For example, is a given runner member becomes damaged, it can be removed and replaced by the simple expedient of removing the damaged runner and replacing it with an undamaged runner member, and substantial grid disassembly is not required in any way. Alternatively, it may be desired to install a lighting fixture 52 of the type illustrated in FIG. 7, which is mounted on a modified runner member 12*e* having an opening in the web 16 thereof above which the fixture is mounted. When the installation of an additional fixture is required at a particular location, it is merely necessary to remove the standard runner member 12 and substitute therefore a runner member 12*e* which is provided with an opening to receive a lighting fixture, as illustrated in FIG. 7. Such runner is then installed either before or after the mounting of the lighting fixture. Conversely, in some instances, it may be desired to remove a lighting fixture from an existing grid. Here again, the runner member on which the fixture is mounted is merely removed from the existing grid and replaced with a conventional runner member, and it is not necessary to disassemble any substantial portion of the grid.

Reference should be made to copending application Ser. No. 214,172, filed Dec. 8, 1980 (assigned to the assignee of the present invention), now U.S. Pat. No. 4,407,011, which discloses in greater detail and claims the lighting fixture mounted on a grid runner of the type illustrated herein and which is shown in FIG. 7. It should also be understood that this invention in its broader aspects allows removal and replacement of runner members to provide other types of accessories, such as air boots, audio systems, and the like.

With the present invention, the simple clip 14 provides the entire connection required to produce an assembly of two identical runner members. Therefore, with this simple connector clip in combination with two runner members, the advantage of double length runner assemblies for initial construction of grids are achieved, while permitting the removal and replacement of a single runner member without grid instability when desired. Additionally, when single length runner members are required for fill in a ceiling grid, it is a simple matter to disconnect the two runner members of an assembly and install the single runner members in any location where they are required.

Although the preferred embodiment of this invention has been shown and described, is should be understood that various modifications and rearrangements of the parts may be resorted to without departing from the scope of the invention as disclosed and claimed herein.

What is claimed is:

1. A suspension ceiling grid system comprising a plurality of runner assemblies adapted to be installed as units in said grid system, each assembly including a plurality of endwise aligned runner members, each assembly having identical first connections at each end and identical second connections at a location spaced from its ends, said first and second connections having a different structure, connector means releasably connecting said endwise aligned runner members of each assembly with sufficient strength and rigidity to permit the handling of each assembly as a unit prior to and during installation thereof in said grid, said first connections of an assembly being connectable with said second connections to form a grid in which associated assemblies extend substantially perpendicular to each other, said connector means and individual runner members being removable and replaceable in an assembled grid without substantial disassembly of said grid, said first connections being operable to connect to both runner members of said pair of runner members, said first connections being releasable from one runner without releasing the other member of a pair of runner members.

2. A suspension ceiling grid system as set forth in claim 1, wherein said pair of runner members abut at their ends, and each of said runner members provides one-half of said second connection adjacent to said abutting ends.

3. A suspension ceiling grid system as set forth in claim 2, wherein said first connections are operable to bridge said abutting ends.

4. A suspension ceiling grid system as set forth in claim 3, wherein said abutting ends of said pair of runner members are connected by a third connection.

5. A suspension ceiling grid system as set forth in claim 4, wherein said third connection is a clip bridging said abutting ends, said clip being removable after an assembly is installed in the grid.

6. A suspension ceiling grid system as set forth in claim 5, wherein said runner members provide a central web, an upstanding wall at each side of said web, and a panel support flange extending from each upstanding wall in a direction away from said web, said clip being mounted between said upstanding walls.

7. A suspension ceiling grid system as set forth in claim 6, wherein said clip is channel-shaped and provides projections which lock into said upstanding walls of both of said runner members, such clip and upstanding walls being deflectable to release said projections for removal of said clip.

8. A suspension ceiling grid as set forth in claim 1, wherein said first and second connections include dual connections providing a separate connection with each of a pair of runner members in a runner assembly, said separate connections being individually releasable to permit removal of one member from a grid while said grid remains stable.

9. A suspension ceiling grid system as set forth in claim 1, wherein said runner members provide a central web having upstanding walls along each side thereof and a panel supporting flange extending from each upstanding wall in a direction away from said web, and said connecting means includes a clip interconnecting said aligned runner members, said clip being removable without disconnecting said first and second connections.

10. A suspension ceiling grid as set forth in claim 9, wherein said clip is channel-shaped and is positioned above said webs, said clip bridging said abutting ends and connecting to each runner member adjacent to said abutting ends.

11. A suspension ceiling grid as set forth in claim 10, wherein at least one of said runner members is adapted to connect with an accessory, and removal of said runner member permits removal of said accessory.

* * * * *